United States Patent [19]

Chen et al.

[11] Patent Number: 4,771,489

[45] Date of Patent: Sep. 20, 1988

[54] ADJUSTABLE, MULTI-PURPOSE TYPE OF SICK BED CONVERTIBLE TO WHEEL-CHAIR

[76] Inventors: Liang T. Chen; Liang H. Chen, both of No. 1, Lane 57, Ling Chou E. Street, Tainan City, Taiwan

[21] Appl. No.: 873,434

[22] Filed: Jun. 4, 1986

[51] Int. Cl.[4] ..... A47K 4/00; A61G 7/02

[52] U.S. Cl. ..... 5/90; 4/585; 5/68

[58] Field of Search ..... 5/90, 66, 67, 68, 69; 4/546, 547, 567, 585, 471; 297/DIG. 4; 280/648

[56] References Cited

U.S. PATENT DOCUMENTS

| | | | |
|---|---|---|---|
| 504,443 | 9/1893 | Staab | 5/90 |
| 826,978 | 7/1906 | Whittington | 5/90 |
| 1,922,104 | 8/1933 | Lukens | 5/90 |
| 2,215,636 | 9/1940 | Comper | 5/90 |
| 2,500,544 | 3/1950 | Haskins | 5/90 |
| 2,632,185 | 3/1953 | Eckart et al. | 5/90 |
| 2,869,614 | 1/1959 | Wamsley | 5/90 |
| 2,899,694 | 8/1959 | Horowitz | 5/90 |
| 3,038,174 | 6/1962 | Brown | 5/90 |
| 3,050,741 | 8/1962 | Coleman | 5/90 |
| 3,618,968 | 11/1971 | Greer | 297/DIG. 4 |
| 3,719,962 | 3/1973 | Burkley | 5/90 |
| 4,055,863 | 11/1977 | Duval | 4/567 |
| 4,079,990 | 3/1978 | McMunn et al. | 297/DIG. 4 |
| 4,127,906 | 12/1978 | Zur | 5/90 |
| 4,152,792 | 5/1979 | Glintz | 5/90 |
| 4,165,127 | 8/1979 | Vago | 297/DIG. 4 |
| 4,183,578 | 1/1980 | Naganawa | 297/DIG. 4 |
| 4,258,445 | 3/1981 | Zur | 5/90 |
| 4,307,477 | 12/1981 | Jacobsen | 5/90 |
| 4,713,850 | 12/1987 | Flaherty et al. | 4/585 |

*Primary Examiner*—Alexander Grosz
*Assistant Examiner*—Eric K. Nicholson
*Attorney, Agent, or Firm*—Browdy and Neimark

[57] ABSTRACT

An adjustable type of wheeled sick bed can also act as a wheel chair, having a spring mattress in three sections pivoting with each other. The mattress is structured in a weblike network, and under its front and rear sections are provided rocker gears for rotating the sections from a horizontal position to yield the wheel-chair. A sump is provided beneath the central section of the mattress to exhaust via a drainage pipe or urinal. A plastic covering is hung vertically to cover the front and rear sections of the bed, to shield the patient while taking a bath on the bed, the sullied water of the bath exiting via the sump and drainage pipe. The central part of the bed, at a point corresponding to the buttocks of a patient lying in the bed, is provided with a soft, hollow-set round urn, to allow the patient sitting on the bed to eliminate. The sick bed is easy to assemble and disassemble, and is portable, light-weight and highly versatile.

7 Claims, 2 Drawing Sheets

FIG.1
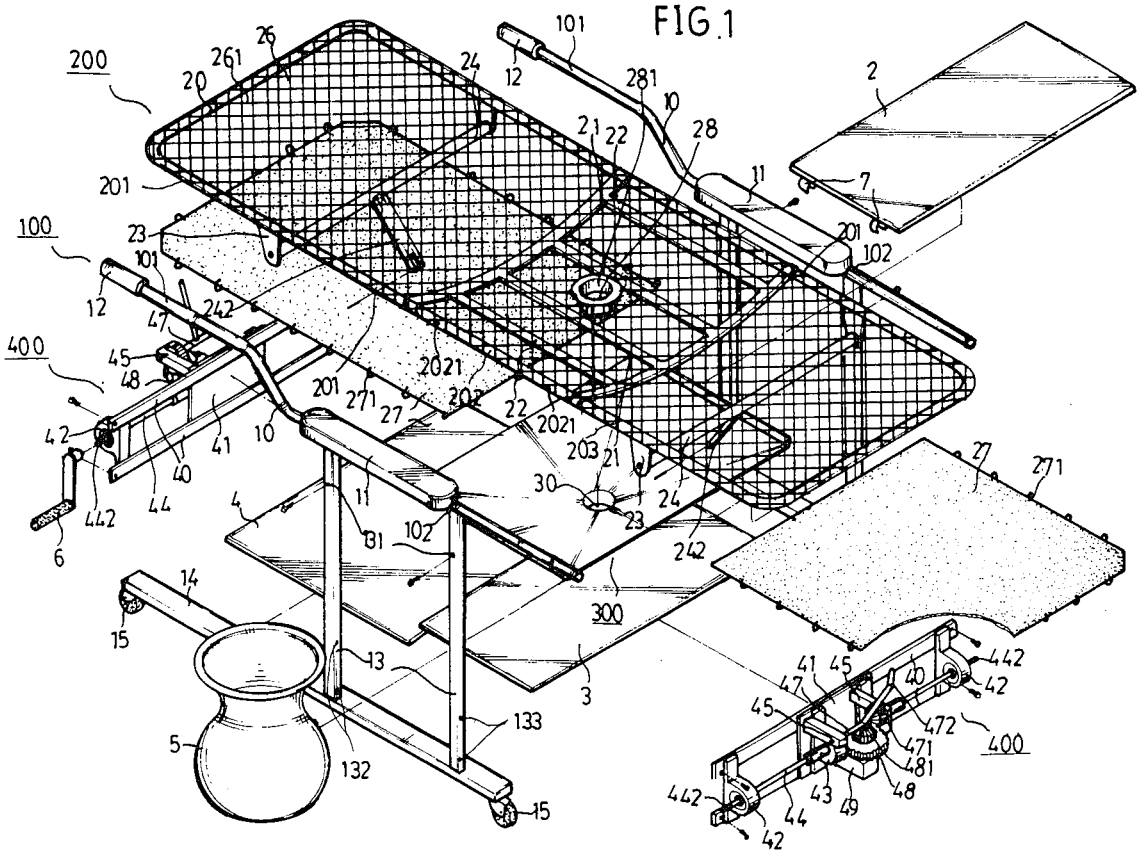
FIG.2
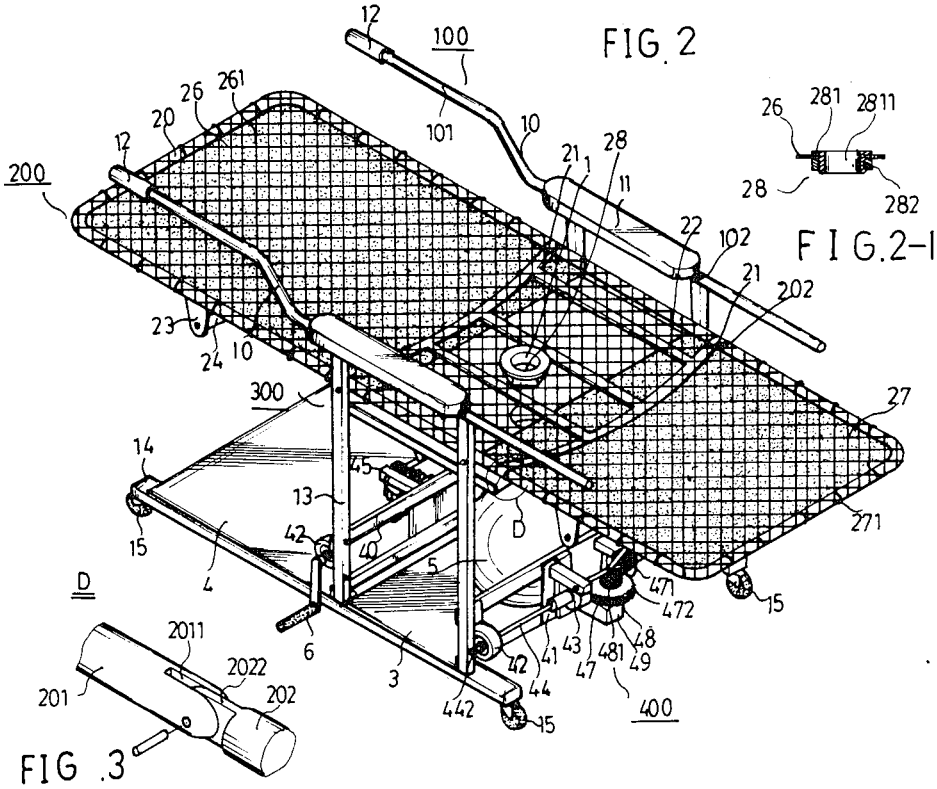
FIG.2-1
FIG.3

ADJUSTABLE, MULTI-PURPOSE TYPE OF SICK BED CONVERTIBLE TO WHEEL-CHAIR

BACKGROUND OF THE INVENTION

The present invention provides the structure of an adjustable, multi-purpose type of sick bed that can serve as a wheel-chair for sitting or lying on and is easily assembled and disassembled, on which the patient may take a bath, urinate or discharge bowel movement comfortably. The bed stand, that is, the mattress, is composed of three web-like sections which are pivotally associated with each other. On the underside of each of the forward and rear sections is provided a rocker gear adjustment means such that, by adjusting the frontal section of the bed to tilt upwardly and adjusting the rear section thereof to tilt downwardly therewith, the sick bed can be converted into a wheel-chair as needed. In a position in the central section of the bed is provided a hollow-set soft urn in association with a sump and drainage underneath. The urn to accommodate discharge of urine and feces as eliminated by the patient lying in the bed in a manner as comfortable as if it were his or her private toilet. For this purpose, a plastic covering may be hung vertically to conceal the underside of the frontal section and of the rear section of the spring mattress together. With a drainage pipe connected to the sump, this also permits the patient to take a bath in the bed, the sullied bath water being confined by the covering shields to flow to the drainage pipe for exhaust. Thus, the bed can be maintained clean and convenient for reclining afterwards.

While advances in medical sciences have come to such a point as to bring much benefits to human beings by relieving their pains and contributing to their health, there is no denying that a thoughtfully designed, ideally structured sick bed is also indispensable. Various services to patients suffering from body amputation and disability, who have to rely on the bed all the time at times during their illness or even all their life, are concerned in addition with medical support.

A conventional sick bed is generally of such a structure that incorporates a fixed type level plank mattress, so that when the patient is unable to walk on foot and has to remain in bed for one reason or another, but has to take pills or have his meals at mealtime, the pillows have to be stacked higher to bring the patient's head higher than the rest of his body in order to feel comfortable while taking the pill or his food. Yet the patient can hardly feel comfortable enough by such efforts of adjustment, and it is a nuisance and inconvenience to have to do so. Thus, the prior proposal has been made to provide a sick bed that permits slight rotative adjustment of the head position. Still, such a design is subject to the following shortcomings.

1. The lack of the provision of a weblike spring mattress and of a hollow sink in the center of the bed means the patient will have to be assisted by the nurse or some non-patient to get to the toilet or when he needs to have his body cleaned and must be assisted back to the bed again. Such assistances are truly a bothersome burden for the assistants, who have to be constantly attentive lest the patients fall down en route. If the patient remains in bed for body cleaning, while this may be all right in cool weather, in some climates it is hardly practicable in summer when it is so hot that the body has to get soaked through in a shower or bathtub in a toilet room or lavatory in order to avoid skin disease and foul smells.

2. For the entire sick bed only the head position is provided a rotative movement of a small amplitude. While this relieves the trouble of having to stack the pillows high. The bed cannot be converted to a wheel-chair that would best benefit the patient if he wishes to lift himself to read or write, or simply to sit up at least once in a while. When he is restricted from body movement by foot, this failure is particularly a pity for those patients who can take solace in reading in a comfortable sitting position.

3. The bed stand, being integral with the castor support by welding, as such cannot be taken apart, takes more space and permits little flexibility for handling and being transported form one place to another, incurring much labor charge and much inconvenience.

4. The necessity to fix an injection fixture and food tray beside the sick bed, which usually occupies space overlapping the aisle, when the patient is injected or having his meal in bed, affects passage by the medical staff in moving from one ward to the next.

It is in view of the foregoing shortcomings and drawbacks of conventional sick beds, that the inventor betook himself to work for improvements therefor, and eventually succeeded in the presentation of the present invention.

SUMMARY OF THE INVENTION

Accordingly, the primary objective of the present invention is to provide such an adjustable, multi-purpose wheel-chair type of sick bed, of which the spring mattress is composed of three sections, the forward and the rear sections each being provided with a rocker gear adjustment means, which can function to adjust the tilt slope of both sections with respect to the bed stand, so that the mattress may be converted virtually form a level position to a wheel-chair, so that the patient in bed can shift from a reclined posture to a sitting posture without supports or assistances from other people, all by himself.

A further object of the present invention is to provide such an adjustable, multi-purpose wheel-chair type sick bed, whereof the mattress is made of a weblike network. A plastic covering is provided for hanging as a shielding fence enclosing the frontal and the rear sections, so that the patient may take a bath right on the bed. The sullied water of the bath flows into the sump for exit via a drain from the sump.

A further objective of the present invention is to provide such an adjustable, multi-purpose wheel-chair type of sick bed, wherein a soft urn, serving the purpose of a bedpan, is provided in engagement with a correspondingly curved hollow provided in the central portion of the bed, to accommodate urination or stool discharge by the patient in the bed, the excrement being collected by falling into the drainage system via the sump. A urinal or toilet can be provided at the outlet of the sump.

A further objective of the present invention is to provide such an adjustable, multi-purpose wheel-chair type sick bed, which incorporates a pair of handrests on both sides of the mattress to serve as guard rails when the patient is sleeping in the bed. Such a pair of handrests may serve to be rested upon by the patient's elbows when the sick bed is converted to and serves the purpose of a regular wheeled armchair, and incorporates a pair of handles as extensions of the two handrests to serve the purpose of handles to facilitate pushing when the sick bed is converted to a wheel-chair.

A further object of the present invention is to provide such an adjustable, multi-purpose wheel-chair type sick bed, whereof a fixing hole is provided in front of each handrest on both sides of the middle of the sick bed, to facilitate the insertion of a supporting stem to which objects such as an injection bottle, towels, cups, etc., can rest upon. It is further possible to put a cushion board between the pair of handrests abeam the handle, on which newspapers, magazines, other things may be put for reading. This allows other enjoyments by the patient in bed, including serving meals in bed, without having to use additional floor space, so that the medical staff may move around the ward with more ease.

A further objective of the present invention is to provide such an adjustable, multi-purpose wheel-chair type sick bed, which is made of module parts that can be assembled and disassembled with equal ease, so that handling and transportation can be made with the utmost convenience. This permits saving space and is convenient at many times, even if the bed is in active use.

Other features and advantages of the present invention will emerge from the following descriptions of embodiments which are given by way of illustration, but are not intended to be in any way limiting, with reference to the accompanying drawings in which:

BRIEF DESCRIPTION OF THE DRAWINGS

FIG. 2 is an assembly view of the sick bed of the present invention;

FIG. 2-1 is a side view of the excremental urn serving the purpose of a bedpan, for the sick bed of the present invention;

FIG. 3 is an enlarged view of the pin coupling for assembling the bed frame of the sick bed;

FIG. 5-1 is an illustration of the linkage in the bed adjustment means in communication with the strutting terminals on the underside of the front and rear sections of the bed stand for the sick bed.

Figure 4:
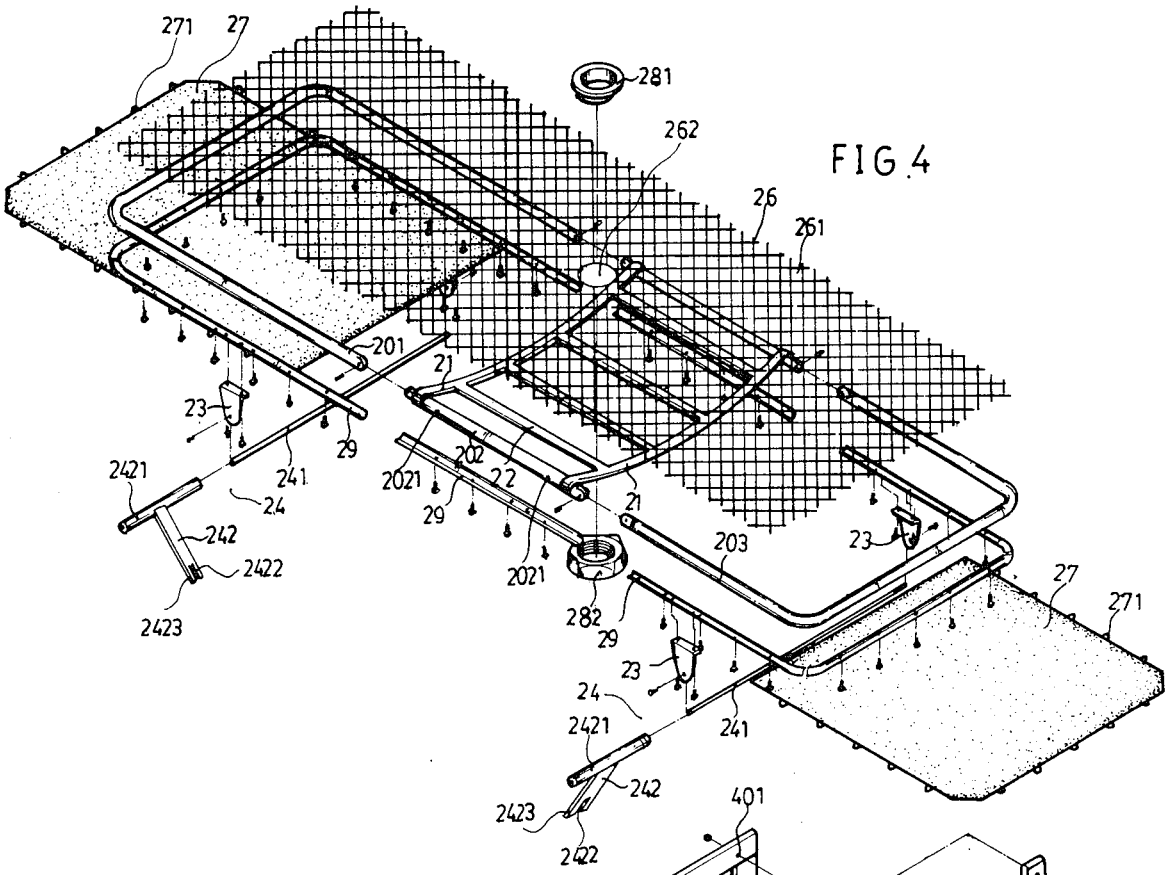
FIG. 4 is an analytical perspective of the spring mattress for the sick bed.

The following is provided as a description of the reference numerals employed hereunder: 100 handle rail, 200 bed planking, 300 sump, 400 adjustment means, 10 bent handle section, 101 handpush, 102 fitting hole, 11 handrest, 12 handgrip, 13 pillar, 131 screw hole, 132 penetration hole, 133 passage hole, 14 chassis rods, 15 wheel 16 stay, 20 bed frame, 201 frontal section, 2011 coupling hole, 202 middle section, 2021 screw hole, 2022 coupling stem, 203 rear section, 21 arched strut, 22 reinforcement planking, 23 supporting lug, 24 strut, 2422 coupling slot, 2423 pin hole, 2421 cross sleeving, 261 web eye, 262 annular access hole, 27 plastic covering, 271 hook ring, 28 excremental urn, 281 hollow hold, 2811 inner hole, 282 fixing ring, 29 surface fitting, 30 drain, 40 master bearing support, 401 penetration hole, 41 crucial plate, 482 bearing mounting, 43 bearing mounting, 44 transmission shaft, 441 worm stem, 442 square head, 45 axle support, 451 fitting hole, 46 axle, 47 tubular shaft, 471 bevel gear, 472 link, 4721 pin hold, 48 worm gear, 481 bevel gear, 42 mandrel, 49 bearing support, 491 inner hole, 50 bearing, 2 object support, 3 flat board, 4 flat board, 5 urinal, 6 rocker arm, 7 reed joint, alpha —80°, beta—20°.

DESCRIPTION OF PREFERRED EMBODIMENTS

Figure 5:
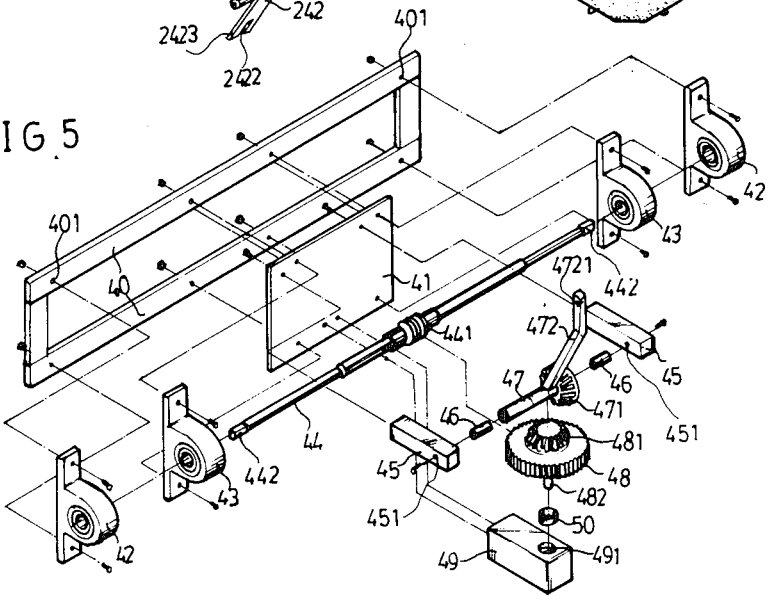
FIG. 5 is a break-away perspective of the bed adjusting means for the sick bed.
Figures 1, 5:
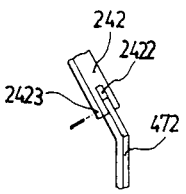
FIG. 1 is a three-dimensional perspective of an adjustable, multi-purpose wheel-chair type of sick bed, according to the present invention.

Referring first of all to FIG. 1, it is seen that the adjustable, multi-purpose wheel-chair type of sick bed of the present invention is composed essentially of two handle rails 100, the bed planking 200, a sump 300, and two adjustment means 400.

We begin with a detailed description of the handle rail section 100. A pair opposite each other are provided, having a chassis rod 14 provided on the underside, and a bent handle section 10 on top. The chassis lever 14 is integrated with the bent handle section 10 by two pillars 13 welded thereto. The handle rail section 100 is provided with a handrest 11 in the middle, and its tail end is turned up for extension into a handpush 101 which is coupled with handle 12. The chassis rod 14 is provided with wheels 15 at the front and rear, and the wheels 15 are provided with stays 16, to facilitate retention of the location of the wheels 15, as desired.

Reference is made to FIG. 2 for further descriptions of the assemblage of other essential parts comprising the sick bed of the present invention.

The chassis foundation of the bed has a pair of handle rails 100 fitted on either side, to permit fixing of the pillars 13 integrally with the handle rails 100. The pillars 13 are secured by the adjustment means 400 via the penetration holes 132 at the front of one pillar 13, and another adjustment means 400 is to be screwed to a passage hole 133 at the rear of another pillar 13, below the handle rails 100, whereby the handle rails 100 and the adjustment means 400 serve as the chassis of the bed.

As regards the bed planking 200, it is fitted between the two handle railings 100 by having screws engaging the screw holes 2021 in the middle section 202 of the bed, at an elevation approximately 20 cm below the handrest 11. A movable rod stay 242 is provided below each of the front section 201 and the rear section 203, respectively, to facilitate coupling with the adjustment means 400 of which the detail will be given later in the text.

The sump 300 is located directly below the central section 202 of the bed, which is fixed to the pillar 13 relative to both handle railings 100 by screws respectively.

The disclosure thus makes clear how the first advantage of the sick bed of the present invention is achieved, that is, the bed permits easy assembly and disassembly without having to use much space, and easy transportation and handling.

Referring to FIG. 4, a detailed analytical view of the bed planking 200 portion of the invention is shown, in which the bed planking 200 comprises such parts as the bed frame 20, bed surface 26, surface fitting 29, excremental urn 28, plastic covering 27 and strut 24. The bed frame 20 is composed of a forward section 201, a middle section 202, and a rear section 203. The framework of the forward section 201 resembles the letter n shifted by ninety degrees in the counterclockwise direction, and that of the rear section 203 resembles the letter n shifted by ninety degrees in the clockwise direction. The middle section 202 has a square form and includes the arched stems 21 curving down on both sides and four reinforcement plankings 22 distributed equidistantly thereon, so as to reinforce the structure of the middle section 202 to bear heavier loads.

For the embodiment of the forward section 201 and the middle section 202, reference is made to FIG. 3, in which is seen a coupling hole 2011 over the tail end of the front section 201, and a coupling fin 2022 projecting on both sides of the middle section 202. Pin holes are provided in both the coupling hole 2011 and the coupling fin 2022. As the coupling fin 2022 is engaged into the coupling hole 2011, for articulated coupling, the front section 201 can be angularly adjusted with respect to the coupling. In much the same procedure, the middle section 202 can be coupled with the rear section 203 by interactions of coupling holes with coupling tips and fins, so that the rear section 203 may also secure angular adjustment with respect to the coupling pins.

Once the forward section 201, the middle section 202 and the rear section 203 have been assembled together to provide the bed frame 20, the surface or sheet 26 may be spread over the bed frame 20. The surface 26 has a weblike 261 formation and made of plastic materials of high strength, for being spread over the bed frame 20 with a tight fit, with its perimeter wrapping over the lower side of the bed frame and being locked in place by pressure from a number of surface fixing pieces 29. In the center of the surface 26 is provided an annular opening 262 for coupling with the excremental urn 28.

The excremental urn 28 is composed of an annular upper hollow hold 281 and a lower fixing ring 282. The upper hollow hold 281 is soft and wide enough on top, for hanging over an annular access hole 262 in the center of the bed spread. Screw threads are provided on the underside protruding down into the annular access hole 262, and for being fixed by the lower fixing ring 282. As is seen by reference to FIG. 2-1, the inner hole 2811 in the hollow hold 281 is the excremental stool for urination and excremental discharges by the patient reclined on the bed.

A watertight plastic covering 27 is provided below the front section 201 and the rear section 203 of the bed spread, having a number of hook rings 271 fixed at equal intervals over the three sides, to facilitate hanging of the plastic covering 27 about the forward section 201 and the rear section 203 of the bed stand when in use, and for easy removal when not in use.

Figure 6:
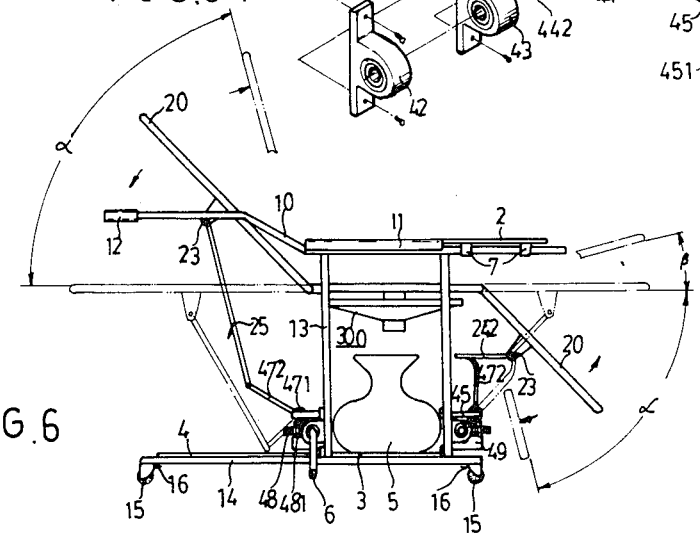
FIG. 6 is an illustration of one embodiment of the bed surface adjustment for the sick bed.

A pair of struts 24 are provided, below the forward section 201 and below the rear section 203, each including two supporting lugs 23, a shaft lever 241 and a stay rod 242. The support lug 23 looks like an ear for locking to the base of surface fitting 29 below the lower rims of both frames of the frontal section 201 and the rear section 203. The shaft lever 241 couples with the stay rod 242, and both ends of the shaft lever 241 are fitted to the support lugs 23 on either side. The stay rod 242 is configured like the letter T, and the internal diameter of the cross sleev ing 2421 is greater than the outer diameter of the shaft lever 241 to bring it to an articulated setting when fitted over the shaft lever 241. The stay rod 242 is welded securely in a vertical direction from the center of the cross sleeving 2421, and its tail end is fitted with a coupling slot 2422 and a pin hole 2423. This facilitates coupling with the link 472 in the bed layout adjustment means 400, which detailed description will be given later in the text. Also, to accommodate the adjusting direction of the forward section 201 as compared to that of the rear section 203, as seen in FIG. 6, the length of the stay rod 242 below the front section 201 is longer than the stay rod 242 below the rear section 203.

Referring to FIG. 5, an analytical perspective of the invention sick bed is shown, wherein the bed adjustment means 400 is composed of a master bearing mounting 40, a crucial plate 41 and a transmission consisting of gear sets. The master bearing mounting 40 is a rectangular member, having a passage hole 401 provided on each of the four corners, to facilitate coupling with the pillar 13 fastened with screws on the handle railing 100. The crucial plate 41 is a flat plate for being screwed onto the central part of the master bearing support 40. Bearing mountings 42, 43 are provided on both ends of the crucial plate 41 on both sides of the master bearing mounting 40 as well. The four bearing mountings are colinear. A transmission shaft 44 is mounted in the bearing mountings 42, 43, the central position of the transmission shaft 44 being fitted with a worm stem 441. Both sides of the transmission shaft 44 are provided with square heads 442. Below the center of the crucial plate 41 is provided a bearing mounting 49, on the top of which are provided two internal holes 491 to accommodate the bearing 50. At the bottom of the worm gear 48 is provided a mandrel 482 for fitting in the bearing 50 for rotation. On top of the worm gear 48 is welded a bevel gear 481, such that the worm gear 48 engages with the worm stem 441 perfectly as the mandrel 482 in the bottom of the worm gear 48 is inserted into bearing 50. On both sides of the crucial plate 41 are provided by projection an axle fitting block 45. The axle 46 couples into the tubular shaft 47, to have both sides screwed to fixing holes 451 on both ends of the axle fitting block 45 by screws. The center of the tubular shaft 47 has an inner opening, of which the inner diameter is a little bit greater than the outer diameter of the axle 46, such that the tubular shaft 47 can be articulated to a desired setting upon engagement. To one side of the tubular shaft 47 is welded a bevel gear 471, for engagement with bevel bear 481 on top of the worm gear 48. To the tubular shaft 47 is welded a link 472 having a pin hole 4721 provided on its top, to facilitate coupling securely with the slot 2422 at the tail end of the stay rod 242 on the rear section of the bed 203 upon engagement with the link 472. A better understanding may be had by reference to FIG. 5-1.

The assemblage of the various parts in association with the adjustment means 400 is such that the coupling of link 472 with stay rod 242 controls pivoting of, for instance, the rear section 203 of the bed stands as a result of the worm stem 441 being in transmission with worm gear 48, when the rocker arm 6 is engaged onto any of the four square heads 442 on any side of the transmission shafts 44 for rotation. The bevel gear 481 rotates the bevel gear 471 on the transmissive tubular shaft 47, so as to result in up-and-down swinging of the link 472. This, coupled with stay rod 242 interconnected with the link 472, brings about angular displacement of the rear section 203 of the bed.

The bed adjustment means in the forward section 201 and in the rear section of the bed stand are identical, permitting also easy regulation of the angular setting of the front section 201 of the bed. According to results obtained from various experiments conducted by the inventor, the front section 201 can be adjusted from the level position to an upswung position of 80 degrees, referred to as angle alpha, whereas the rear section 203 also permits adjustment from a level, reference position to a downswung position of 80 degrees, referred to as angle alpha, and in addition adjustment to an upswung position of 20 degrees, referred to as angle beta, as is better seen in FIG. 6. This makes it possible to adjust the head and the legs of the patient reclined in bed to any angular displacement, for his own benefit and as he pleases.

Thus, another important function of the subject invention has been described, namely easy adjustment of the surface of the sick bed.

Referring once again to FIGS. 1 and 2, it is seen that the sump 300 is fitted crosswise by fastening it via the screw holes 131 onto the strutting supports, directly below the central section 202 of the bed. The width is about the same as the width of the middle section 202, the interior sloping down in convergence to a central drain 30 in the center.

The excremental urn 28 is provided under a point in the central area of the middle section 202 of the bed spread formed, together with the sump 300. A flat plate 3 is positioned crosswise between the pillars 13 on the chassis rod 14, and a urinal 5 is placed directly below the central drain 30 in the sump 300 on the flat plate 3. These are arranged to facilitate urination and excremental discharge by the patient lying in bed. The excremental urn 28 serves for all purposes and intents as a bed pan, so that the excrement may discharge to the urinal below via the drain 30 in the sump 300.

This explains another feature of the sick bed of the present invention, namely, the facilitating of natural elimination by the patient directly from the bed, without having to leave the bed.

The enclosure defined by the plastic covering 27 hanging down the front section 201 and the rear section 203 of the bed spread, in relation to the weblike eyelets 261 on the bed surface 26, with the sump 300 in the center, whereby a drainage pipe is connected outdoors via the drain 30 in the sump 30, altogether accommodates the patient on the bed to take a bath in the bed. The sullied bath water finds its way out into the sump 300 by the openings 261 in the web 26, and is laterally limited by the plastic covering 27, to eventually pass out the drain 300.

This explains another feature of the sick bed of the present invention, namely, the permitting of the patient to take a bath in bed, that is, without having to leave the bed.

In addition to such significant advantages realized by the present invention, to accommodate to the patient's having a meal in bed, taking pills or reading pastimes, the bed stand is structured to permit adjustment to a wheel-chair for such purposes. Furthermore, an object support 2 can be removably provided as an extension form the aisle side of the handrest 11, such as an object stand 2 supported by reed inserts 7 on both ends of the bottom of the object stand 2. This facilitates fitting of such reed inserts 7 straddling over the handrest 11 when the flat plate 2 is to be used, in a secured position free from incidental displacing effects.

A fitting hole 102 is provided on either of the two handrests 11, to facilitate fitting of cupboard or injection supports.

A flat board 4 is provided in front of the base chassis lever 14 relative to the two handrests 100, to accommodate setting of reading materials thereon.

The disclosure thus makes clear how the many advantages provided by the adjustable, multi-purpose wheel-chair type of sick bed of the present invention to hospitalized patients, particularly those patients who have to remain in bed the whole day due to disability or amputation. The bed of the present invention is especially remarkable in the following respects:

1. All constituent parts permit easy assembly and disassembly, handling and transportation and saving of space.

2. The bed surface is structured in a weblike configuration for facilitating ventilation, and for permitting the patient in bed to take baths in bed by drawing down the plastic covering shields removably fitted thereto.

3. An excremental urn is provided on the bed surface serving the purpose of a regular bedpan, to facilitate discharge of urine and feces by the patient in bed without departure from the bed.

4. A handrest portion is provided higher than the surface level of the bed, to function as a protective means while the patient is reclined in bed, to prevent the patient from rolling on the ground during sleep, and to function as a handrest when the patient sits up to have a meal or to read.

5. The surface of the bed and the bed stand are structured in three sections, which, together with bed adjustment means provided in addition, permit adjustment of the bed stand to any suitable position as determined by the patient himself, even to be converted virtually into a wheel-chair, so that the patient may be pushed or have himself pushed outdoors to get some exposure to sunshine or for outdoor activities by actuating the wheels underneath, by exertion of the handrests or handles.

6. The fitting holes are provided on the handrest and extensions thereof to accommodate cupboards or injection support, and a flat board can be hung crosswise over the handrailings, to facilitate the patient taking his meal in bed, or for enjoying reading in bed, which can be easily removed when no longer needed for use for the time being.

The disclosure thus makes clear the merits of the bed of the present invention for use by hospitalized patients, particularly those suffering from hemiplegia, cerebral congestion, other diseases whereby the patient has lost control of himself for days, weeks, or longer, or who has to linger in bed for long periods, for whom eating, body cleaning, and natural discharges can be handled or taken care of in bed, in a bed structured as claimed hereunder.

We claim:

1. A bed, comprising a frame with a middle section, said frame also including front and rear sections pivoting from respective opposite front and rear ends of said middle section, each of said front and rear sections having a stay extending between opposing sides thereof, a structure for supporting said frame, including a pair of bottom bars with wheels for moving the bed, a respective pair of vertical struts having bottom ends welded to the respective one said bottom bars, said vertical struts having upper ends attached to respective hand rail portions and handrests, and said vertical struts having top ends connected to said middle section, a patient-supporting layer strung across said sections of said frame, with a passage means for excrement from the patient located in said patient-supporting layer near the middle of said middle section, a sump supported by said vertical struts below said middle section, two sheets respectively connected to bottom portions of said front and rear sections for channeling water falling from said patient into said sump, and two control means respectively connected between said supporting structure and said stays, for selectively setting the angle of each of said front and rear sections with respect to said middle section, wherein said middle section with said sump remains stationary with respect to said structure for supporting said frame while each of said front and rear sections can be pivoted from said middle section to change said angles of said front and rear sections can be changed to allow the patient to be supported in a sitting or lying position, and to selectively effectively convert said bed into a wheel-chair, so that the patient can be washed and allowed to eliminate in bed, while wastes of the patient are collected via said sump.

2. The bed in accordance with claim 1, wherein an excrement passage is provided between a central portion of said patient-supporting layer corresponding to said middle section of said frame, said excrement passage including a top fitting and a lower fitting connecting together to compress a respective part of said patient supporting layer therebetween.

3. An adjustable, multi-purpose type of sick bed that can be converted into a wheelchair, said sick bed comprising:

two handrest portions;

a bed stand having a rectangular middle section and front and rear sections;

a mattress portion on said bed stand;

two bed adjustment means for respectively adjusting the front and rear sections of the bed stand;

a sump located below said middle section of the bed stand for receiving waste from a patient lying in bed;

wherein:

said two handrest portions are provided along two sides of the bed by welding said handrest portions to top portions of two vertical strutting members which are welded at bottom portions thereof to chassis rods, a middle of each said handrest portion is provided with a respective support board, a tail end of each said handrest portion extends toward the rear section for pushing the bed, and wheels are provided on the bottom of front and rear ends of the chassis rods;

each of said front and rear sections of the bed stand is configured like the letter n and shifted by ninety degrees in an opposite direction from the other to connect to said middle section, and each of said front and rear sections is connected to pivot from respective ends of the middle section;

said front, rear and middle sections are topped by said mattress portion, said mattress portion being made of weblike spring material;

said middle section of said bed stand is connected to said vertical strutting members and reinforced by arched stems sinking down and between two sides thereof, and reinforcement boards are provided between said arched stems; coupling fins are projected on both front and rear sides of said middle section, coupling grooves are provided in the ends of said front and rear sections, pinning holes are provided in the ends of the front and rear sections, pinning holes are provided in the coupling fins and in walls of the coupling grooves, pins are inserted to couple the front and rear sections to the middle section for an articulated pivoting thereof and to enable different adjustment of the front and rear sections;

each of said front and rear sections are journalled by a respective stay rod attached thereto, the stay rod for the front section being longer than the stay rod for the rear section, and a tail of each said stay rod being provided with a coupling slot and a pin hole penetrating said tail of each said stay rod, adjacent said coupling slot;

a hanging plastic covering is provided below each of the front and rear sections of the bed stand, said hanging plastic covering having hooks for being connected to the sides of said front and rear sections other than a respective side adjacent said middle section, for hanging to collect water from the patient taking a bath on the bed by channeling the water into said sump;

an excremental urn connected in the central portion of the middle section to facilitate discharge from the bed of matter eliminated by the patient in bed;

two bed adjustment means are provided for adjusting the angular position of said front and rear sections with respect to said middle section, each said bed adjustment means including a worm stem on a transmission shaft and engaging a respective worm gear having a bevel gear welded to the worm gear for rotating an axle stem attached thereto, a link welded to said axle stem, so as to swing the link up-and-down by the rotation, and a pinning hole provided ahead of the respective link for coupling with the respective one of said stay rods below the front and rear sections of the bed stand; and said sump is shaped like a funnel, the perimeter of which slopes down taperwise to a central drain thereof, said sump being located directly below the middle section of the bed stand and supported by said strutting members to which the handrests are connected on both sides of the bed, to facilitate discharge of sullied bath water or matter eliminated by the patient in bed;

whereby, easy assembly and disassembly of the sick bed, easy adjustment of the reclining angle of the front and rear sections of the bed, easy conversion into a wheel-chair, and elimination and bathing by the patient in bed are enabled.

4. The bed according to claim 3, wherein an excremental area is provided by said excremental urn in the middle of the middle section of the bed stand, said excremental urn including a top ring through which matter eliminated by the patient in bed passes, extending through said middle section and locked thereon by a fixing ring from below, and an elimination area of said mattress portion corresponding to the location of said excremental urn in said middle section being soft and supple substances to prevent the patient from feeling ill at ease while lying in bed.

5. The bed according to claim 3, wherein said central drain of the sump can be connected to the outdoors by a drainage pipe when the patient in bed is going to have a bath in bed, or terminated into a urinal placed straight below the central drain when the patient is going to eliminate in bed, said urinal being placed upon a flat board extendng between the two strutting members.

6. The bed according to claim 3, wherein an object recipient board is provided to extend from said handrest portions across a central part of said mattress portion, a bottom of said object recipient board being fitted with reed inserts for operative attachment on either side to said to said handrest portions with said support boards.

7. The bed according to claim 5, said object recipient board having a front side with fitting holes into which a further support can be selectively inserted for medical services or for holding an object to be used by the patient.

* * * * *